United States Patent [19]

Ishida

[11] Patent Number: 4,788,551

[45] Date of Patent: Nov. 29, 1988

[54] APPARATUS FOR STORING AN ANTENNA FOR VEHICLE

[75] Inventor: Kengo Ishida, Ichikawa, Japan

[73] Assignee: Nissan Motor Co., Ltd., Yokohama, Japan

[21] Appl. No.: 891,378

[22] Filed: Jul. 31, 1986

[30] Foreign Application Priority Data

Aug. 8, 1985 [JP] Japan ..... 60-174452

[51] Int. Cl.[4] ..... H01Q 1/32

[52] U.S. Cl. .....343/713; 343/711

[58] Field of Search ..... 343/711, 713, 712, 714, 343/715

[56] References Cited

U.S. PATENT DOCUMENTS

| | | | |
|---|---|---|---|
| 1,621,404 | 3/1927 | Harvey | 343/713 |
| 1,844,548 | 2/1932 | Hammerl | 343/713 |
| 2,289,173 | 7/1942 | Best | 343/712 |
| 2,774,811 | 12/1956 | Shanok et al. | 343/713 |
| 4,253,099 | 2/1981 | Yamazaki et al. | 343/713 |
| 4,254,419 | 3/1981 | Noddin | 343/715 |

*Primary Examiner*—William L. Sikes
*Assistant Examiner*—Hoanganh Le
*Attorney, Agent, or Firm*—Foley & Lardner, Schwartz, Jeffery, Schwaab, Mack, Blumenthal & Evans

[57] ABSTRACT

An apparatus for storing an antenna for vehicle comprises a first roof device forming a portion of the vehicle roof, a second roof device cooperating with the first roof device to form therebetween a space for storing the antenna, and a supporting device for supporting the antenna and allowing the antenna to be pivotally moved such that the antenna is put in and out of the space.

13 Claims, 2 Drawing Sheets

APPARATUS FOR STORING AN ANTENNA FOR VEHICLE

BACKGROUND OF THE INVENTION

The present invention relates to an apparatus for storing an antenna for vehicle mounted on the roof thereof.

It is well known that an antenna for vehicle is mounted on a roof panel of the vehicle. Such an example is seen in "SKYLINE" of types E-PJR30, E-UJR30, E-HR30 and K-ER30 made by Nissan Motors Co., Ltd. In an apparatus for attaching an antenna in these types, a support portion for supporting the antenna is disposed in the front portion of the roof panel. The antenna is supported by the support portion at one end thereof and the other end of the antenna is moved toward and away from the roof panel by a lever attached to the support portion and projecting into the compartment of the vehicle. The length of the antenna may be changed manually or by a power antenna mechanism provided with a driving device for increasing and decreasing the length of the antenna.

In such a conventional apparatus for attaching an antenna for vehicle to the roof thereof, the antenna and the support portion for supporting the antenna project above the roof panel so that the antenna is easily damaged by an accidental external force. For example, the end tip of the antenna may be caught in a brush and deformed during the washing operation of an automatic washing machine for washing a vehicle. Furthermore, the antenna tends to be damaged during the parking of the vehicle since a person can easily come in contact with the antenna.

SUMMARY OF THE INVENTION

To overcome the problems mentioned above, an object of the present invention is to provide an apparatus for storing an antenna for vehicle in which the antenna is not easily damaged by an accidental external force or contact with a person.

With the above object in view, the present invention is directed to an apparatus for storing an antenna for vehicle comprising first roof means forming a portion of the vehicle roof, second roof means cooperating with the first roof means to form therebetween a space for storing the antenna, and supporting means for supporting the antenna and allowing the antenna to be pivotally moved such that the antenna is put in and out of the space.

BRIEF DESCRIPTION OF THE DRAWINGS

The present invention will be more apparent with reference to the preferred embodiments thereof in conjunction with the drawings in which.

DETAILED DESCRIPTION OF THE PREFERRED EMBODIMENTS

Figure 1:
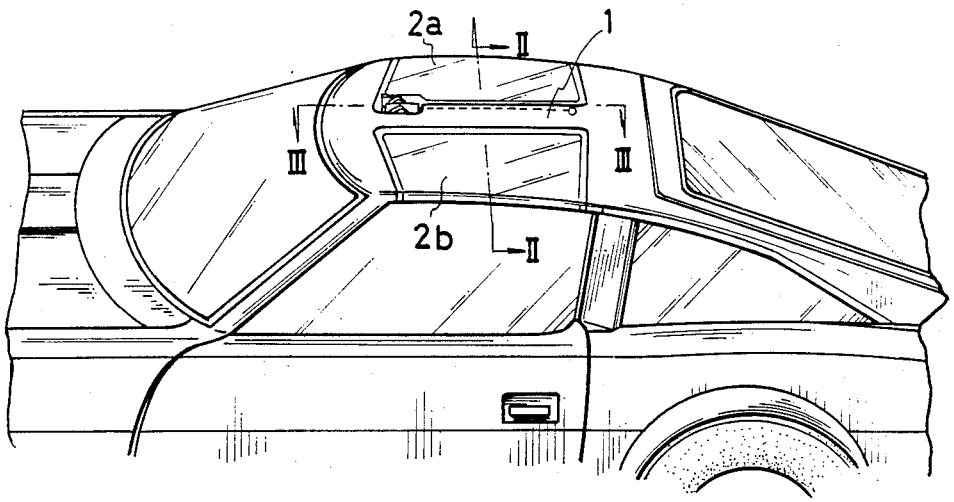
FIG. 1 is a perspective view showing the appearance of an apparatus for storing an antenna for vehicle according to one embodiment of the present invention.
Figure 2:
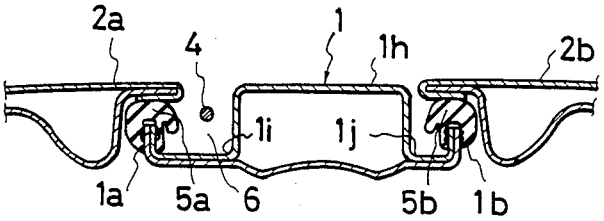
FIG. 2 is an enlarged sectional view taken along line II—II of FIG. 1.

Referring now to FIG. 1, an elongated central roof panel 1 is secured to a vehicle body and a pair of movable roof panels 2*a* and 2*b* are detachably disposed on both sides of the central roof panel 1. As shown in FIG. 2, the central roof panel 1 has a generally rectangular central portion 1*h* in the center thereof and L-shaped side portions 1*i* and 1*j* on both sides of the central portion 1*h*. Inner weather strips 5*a* and 5*b* are mounted on the flanges 1*a* and 1*b* of the side portions 1*i* and 1*j*, respectively. The ends of the movable roof panels 2*a* and 2*b* on the central sides thereof respectively contact the inner weather strips 5*a* and 5*b* so that the movable roof panels 2*a* and 2*b* are hermetically connected to the flanges 1*a* and 1*b* of the central roof panel 1 through the weather strips 5*a* and 5*b*, respectively.

Figure 3:
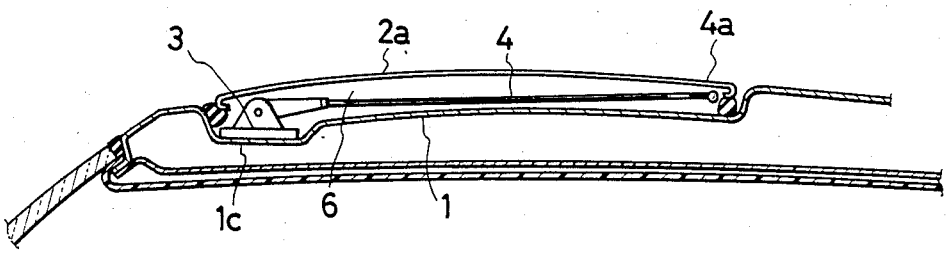
FIG. 3 is an enlarged sectional view taken along line III—III of FIG. 2.

The central portion 1*h* and the side portion 1*i* of the central roof panel 1, the inner weather strip 5*a* and the movable roof panel 2*a* form a space portion 6, for storing an antenna 4, having a predetermined length in the longitudinal direction of the elongated central roof panel 1, i.e., the forward and backward direction of the car. However, the space portion 6 may be formed by the central roof panel 1, the weather strip 5*b* and the movable roof panel 2. As shown in FIG. 3, a support portion 3 for movably supporting the antenna 4 is attached to the front portion 1*c* of the central roof panel 1 and is located within the space portion 6. The antenna 4 may be put in and out of the space portion 6 by using a known lever joined to the support portion 3 within the compartment of the car so as to move the antenna 4. Furthermore, the length of antenna 4 may be changed manually or by using a known driving device such as a motor connected to the support portion 3 so as to increase or decrease the length of the antenna 4 by extending or retracting antenna tip 4*a*. In the above embodiment, the uppermost surface of the central portion 1*h* of the central roof panel 1 is substantially located at the same level as the uppermost surfaces of the movable roof panels 2*a* and 2*b*.

Figure 4:
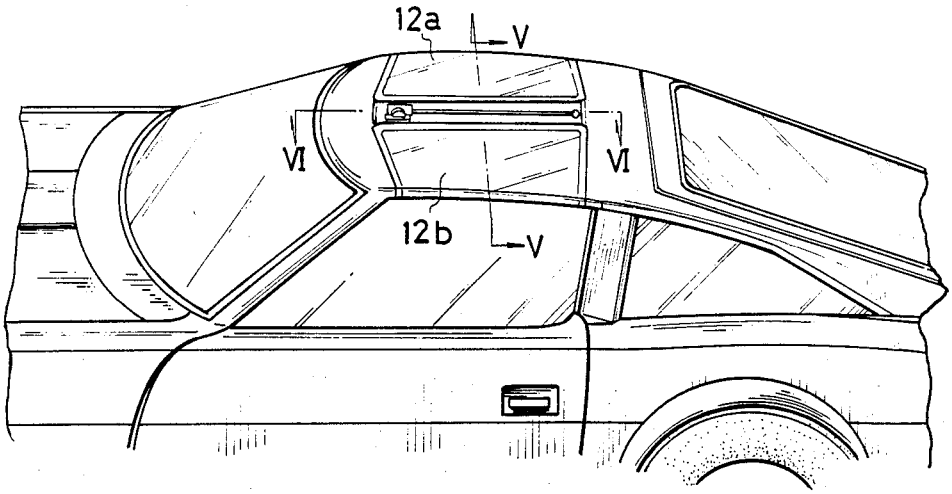
FIG. 4 is a perspective view showing the appearance of an apparatus for storing an antenna for vehicle according to another embodiment of the present invention.
Figure 5:
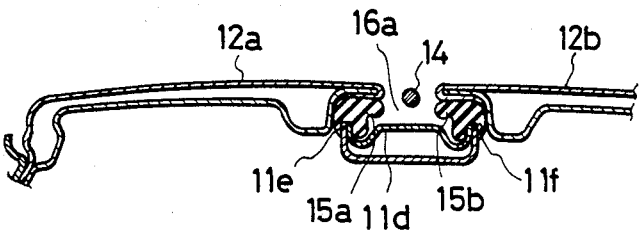
FIG. 5 is an enlarged sectional view taken along Line V—V of FIG. 4.
Figure 6:
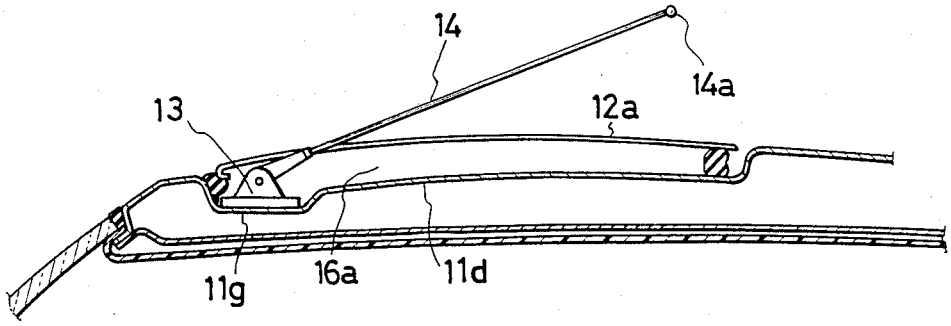
FIG. 6 is an enlarged sectional view taken along Line VI—VI of FIG. 4.

FIG. 4 shows an apparatus for storing an antenna for vehicle according to another embodiment of the present invention. In this embodiment, the ends of movable roof panels 12*a* and 12*b* on the central sides thereof are in proximity to each other and oppose each other. An elongated central roof panel 11*d* is formed such that the uppermost surface thereof is recessed from the uppermost surfaces of the movable roof panels 12*a* and 12*b* by a predetermined length for storing an antenna 14 for vehicle. The central roof panel 11*d* has a pair of flanges 11*e* and 11*f* on both sides thereof for mounting inner weather strips 15*a* and 15*b* thereon, respectively. The inner weather strips 15*a* and 15*b* respectively hermetically contact the ends of the movable roof panels 12*a* and 12*b* on the central sides thereof. Accordingly, the movable roof panels 12*a* and 12*b* and the central roof panel 11*d* form a space portion 16*a* having an elongated opening only in the upper portion thereof. As shown in FIG. 6, a support portion 13 for movably supporting the antenna 14 is attached to the front portion 11*g* of the central roof panel 11*d* and is located within the space portion 16*a*. The antenna 14 is put in and out of the space portion 16*a* by the support portion 13 and a known lever joined to the support portion 13 within the compartment of the vehicle so as to move the antenna 14. Furthermore, the length of the antenna 14 may be changed manually or by a known driving device such as a motor connected to the support portion 13 so as to increase or decrease the length of the antenna 14 by extending or retracting antenna tip 4*a*. FIG. 6 shows a state in which the antenna 4 is rotated around the support portion 13 by a predetermined slanting angle and is put out of the space portion 16*a*.

In the above embodiments mentioned above, the space portions 6 and 16*a* having a predetermined length for receiving an antenna in the forward and backward direction of the vehicle are respectively defined by the central roof panels 1, 11*d*, and the movable roof panels 2*a*, 2*b* and 12*a*, 12*b*. The antenna is movably supported by a support device at one end thereof such that the antenna can be put in and out of the space portions 6 and 16*a*.

According to the construction of the apparatus of the present invention mentioned above, when a vehicle is parked and antenna is not used, the antenna can be stored within the space portion so that the antenna and a support portion for supporting the antenna are hidden from view. When the antenna is used, the antenna is rotated around the support portion by a predetermined slanting angle, thereby easily moving the tip of the antenna from the space portion toward a predetermined portion above the roof. Therefore, the antenna is not caught in a washing brush when the vehicle is washed by an automatic washing machine. Furthermore, since the antenna can be stored within the space portion, the antenna is not easily damaged by an external force and the manual operation of a person. The present invention can be preferably applied to a vehicle provided with the T bar roof described before.

What is claimed is:

1. An apparatus for storing an antenna for a vehicle comprising:

first roof means forming a portion of the vehicle roof, the first roof means having a central roof panel secured to the vehicle body;

second roof means cooperating with the first roof means to form therebetween a space for storing the antenna, the second roof means having moveable roof panels detachably disposed on both sides of the central roof panel and the space being defined by the central roof panel and one of the moveable roof panels in the forward and backward direction of the vehicle body; and supporting means for supporting the antenna and allowing the antenna to be pivotally moved such that the antenna is put in and out of the space, the supporting means being attached to the central roof panel.

2. An apparatus for storing an antenna for vehicle as claimed in claim 1 wherein said movable roof panels are hermetically connected to the central roof panel through inner weather strips.

3. An apparatus for storing an antenna for vehicle as claimed in claim 2 wherein the upper surface of said central roof panel is substantially located at the same level as the upper surfaces of the movable roof panels.

4. An apparatus for storing an antenna for vehicle as claimed in claim 2 wherein said central roof panel is recessed from both movable roof panels to form said space defined by the central roof panel and said movable roof panels.

5. An apparatus for storing an antenna for vehicle as claimed in claim 1 wherein said second roof means is hermetically connected to the first roof means through inner weather strip means.

6. An apparatus for storing an antenna for vehicle as claimed in claim 1 wherein said space is disposed on one side of the central roof panel.

7. An apparatus for storing an antenna for a vehicle comprising:

first roof means forming a central roof panel of the vehicle roof, the central roof panel being secured to the vehicle body;

second roof means having moveable roof panels disposed on opposite sides of the central roof panel and cooperating with said first roof means to form therebetween a space for storing the antenna, the space being defined by the central roof panel and at least one of the moveable roof panels as the central roof panel and the one of the moveable roof panels extends in the forward and backward direction of the vehicle body; and supporting means attached to the central roof panel and supporting the antenna, the supporting means allowing the antenna to be pivotally moved into and out of the space.

8. An apparatus as claimed in claim 7 wherein the movable roof panels are detachably disposed on opposite sides of the central roof panel.

9. An apparatus as claimed in claim 8, wherein the movable roof panels are hermetically connected to the central roof panel through inner weather strips.

10. An apparatus as claimed in claim 9, wherein the upper surface of the central roof panel is located at substantially the same level as the upper surfaces of the movable roof panels.

11. An apparatus as claimed in claim 9, wherein the central roof panel is recessed from both movable roof panels to form the space.

12. An apparatus as claimed in claim 8, wherein the space is disposed on one side of the central roof panel.

13. An apparatus as claimed in claim 7, wherein the second roof means is hermetically connected to the first roof means through inner weather strip means.

* * * * *